US005331701A

United States Patent [19]

Chase et al.

[11] Patent Number: 5,331,701

[45] Date of Patent: Jul. 26, 1994

[54] VEHICLE CHAIR RAMP APPARATUS

[76] Inventors: Vearl J. Chase; Marilyn M. Chase, both of 2400 E. Pleasant Valley Rd., Space 31, Oxnard, Calif. 93033

[21] Appl. No.: 120,075

[22] Filed: Sep. 13, 1993

[51] Int. Cl.[5] ..... A61G 3/06; A61G 3/08

[52] U.S. Cl. ..... 14/71.1; 414/537; 414/921

[58] Field of Search ..... 14/69.5, 71.1, 71.3; 414/401, 522, 537, 541, 921; 296/61, 26, 37.6, 37.14, 57.1; 187/9 R; 108/44, 137, 138; 224/42.44; D34/32

[56] References Cited

U.S. PATENT DOCUMENTS

| | | | |
|---|---|---|---|
| 3,711,882 | 1/1973 | Iller | 14/69.5 |
| 4,589,349 | 5/1986 | Gebhardt et al. | 108/137 X |
| 4,830,243 | 5/1989 | Mann | 224/42.44 |
| 4,900,217 | 2/1990 | Nelson | 414/537 |
| 5,064,335 | 11/1991 | Bergeron et al. | 224/42.44 X |
| 5,090,335 | 2/1992 | Russell | 108/44 |

OTHER PUBLICATIONS

"Rotary Truck Leveler", Rotary Lift Co., Memphis, Tenn., 1955.

*Primary Examiner*—Thuy M. Bui
*Assistant Examiner*—James A. Lisehora
*Attorney, Agent, or Firm*—E. Michael Combs

[57] ABSTRACT

A housing mounted to a vehicle floor is arranged to permit removal and extension of an extension member therefrom, having an extension plate pivotally mounted to the extension member to provide for a ramp structure relative to the associated vehicle. The housing is arranged to include a central plate extending from a first end of the housing to an orientation spaced from a second end of the housing for positioning and mounting of a vehicle chair thereon, with an abutment block extending from the central plate to a second side wall of the vehicle for abutment of a chair wheel, with central plate abutment members positioned on the central plate in adjacency to the first end for securing the chair between the central plate abutment members and the abutment block. Security straps are mounted to the side walls for securement of the chair to the housing top wall.

4 Claims, 5 Drawing Sheets

VEHICLE CHAIR RAMP APPARATUS

BACKGROUND OF THE INVENTION

1. Field of the Invention

The field of invention relates to vehicle chair ramp structure, and more particularly pertains to a new and improved vehicle chair ramp apparatus wherein the same is arranged to provide for ease of access and egress relative to an associated vehicle floor.

2. Description of the Prior Art

Vehicle ramp structure is indicated in the prior art such as exemplified by the U.S. Pat. No. 3,651,965; the U.S. Pat. No. 3,874,527, and the U.S. Pat. Nos. 4,084,713 and 4,966,516.

The instant invention attempts to overcome deficiencies of the prior art by providing for a housing structure arranged for compactness relative to the vehicle floor providing for a central housing and extension ramp structure therefrom and in this respect, the present invention substantially fulfills this need.

SUMMARY OF THE INVENTION

In view of the foregoing disadvantages inherent in the known types of vehicle chair ramp apparatus now present in the prior art, the present invention provides a vehicle chair ramp apparatus wherein the same is directed to the nested securement of a ramp member mounted within the housing permitting extension of the ramp member for access of a wheeled chair relative to the associated vehicle. As such, the general purpose of the present invention, which will be described subsequently in greater detail, is to provide a new and improved vehicle chair ramp apparatus which has all the advantages of the prior art vehicle chair ramp apparatus and none of the disadvantages.

To attain this, the present invention provides a housing mounted to a vehicle floor arranged to permit removal and extension of an extension member therefrom, having an extension plate pivotally mounted to the extension member to provide for a ramp structure relative to the associated vehicle. The housing is arranged to include a central plate extending from a first end of the housing to an orientation spaced from a second end of the housing for positioning and mounting of a vehicle chair thereon, with an abutment block extending from the central plate to a second side wall of the vehicle for abutment of a chair wheel, with central plate abutment members positioned on the central plate in adajcency to the first end for securing the chair between the central plate abutment members and the abutment block. Security straps are mounted to the side walls for securement of the chair to the housing top wall.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved vehicle chair ramp apparatus which has all the advantages of the prior art vehicle chair ramp apparatus and none of the disadvantages.

It is another object of the present invention to provide a new and improved vehicle chair ramp apparatus which may be easily and efficiently manufactured and marketed.

It is a further object of the present invention to provide a new and improved vehicle chair ramp apparatus which is of a durable and reliable construction.

An even further object of the present invention is to provide a new and improved vehicle chair ramp apparatus which is susceptible of a low cost of manufacture with regard to both materials and labor, and which accordingly is then susceptible of low prices of sale to the consuming public, thereby making such vehicle chair ramp apparatus economically available to the buying public.

Still yet another object of the present invention is to provide a new and improved vehicle chair ramp apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
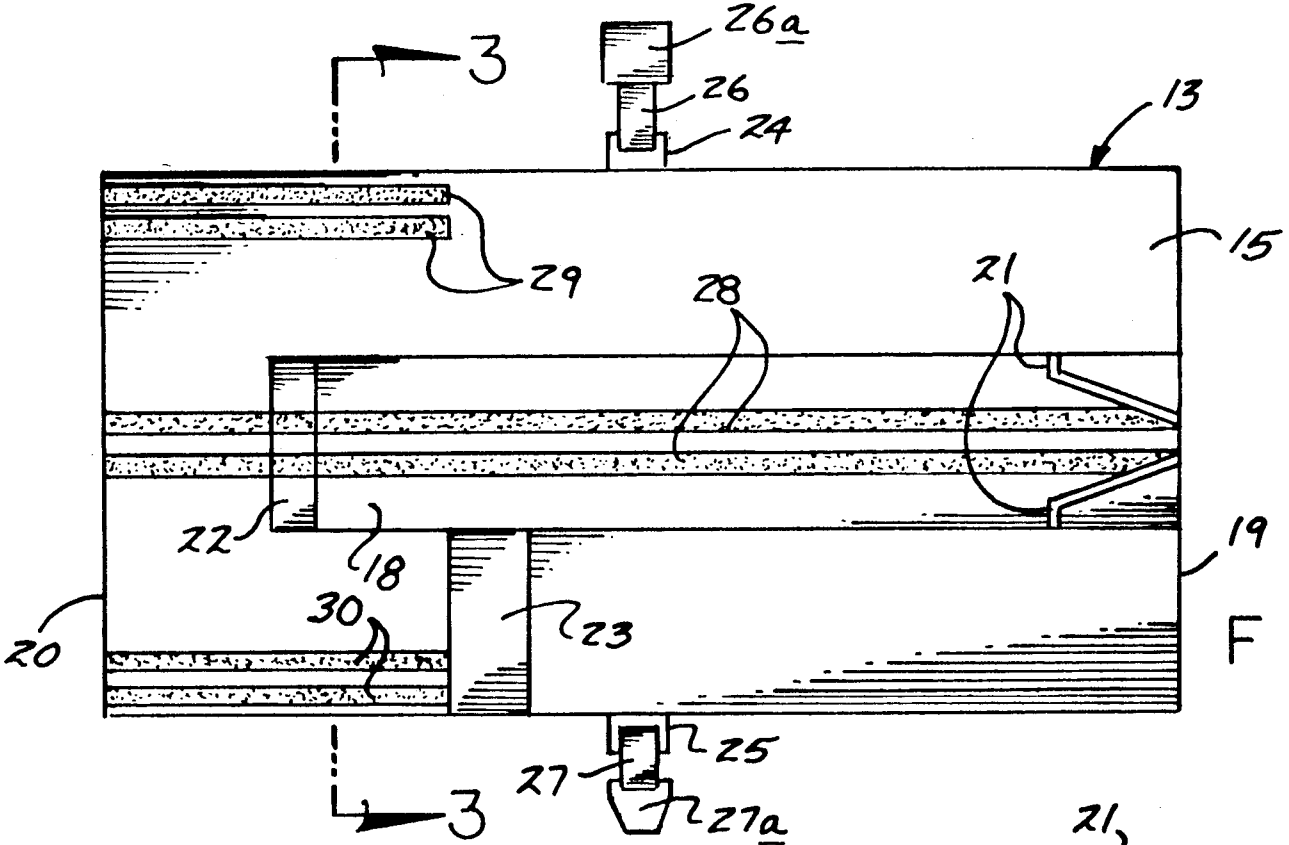
FIG. 1 is an orthographic top view of the housing of the invention.

With reference now to the drawings, and in particular to FIGS. 1 to 10 thereof, a new and improved vehicle chair ramp apparatus embodying the principles and concepts of the present invention and generally designated by the reference numeral 10 will be described.

Figure 8:
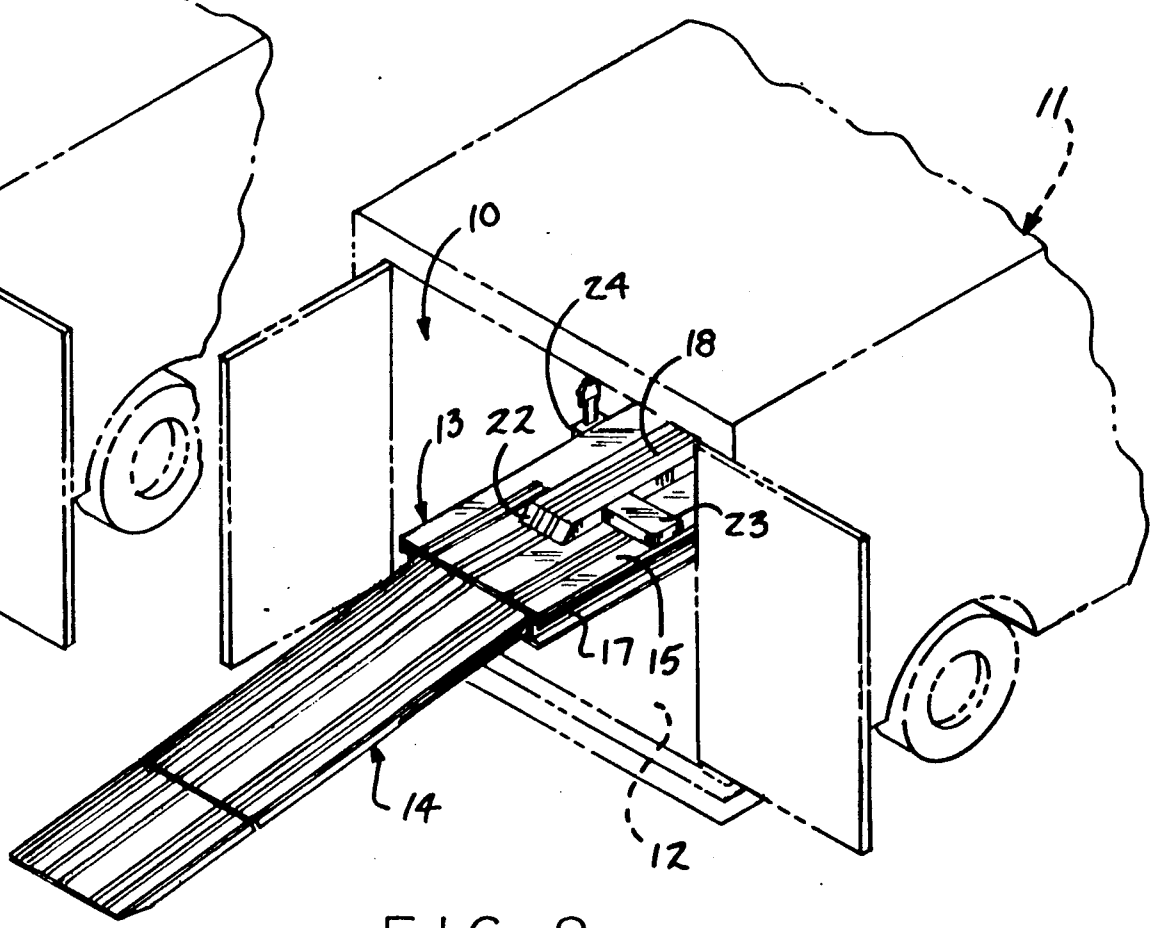
FIG. 8 is an isometric illustration of the invention in an extended orientation relative to the associated vehicle.
Figure 7:
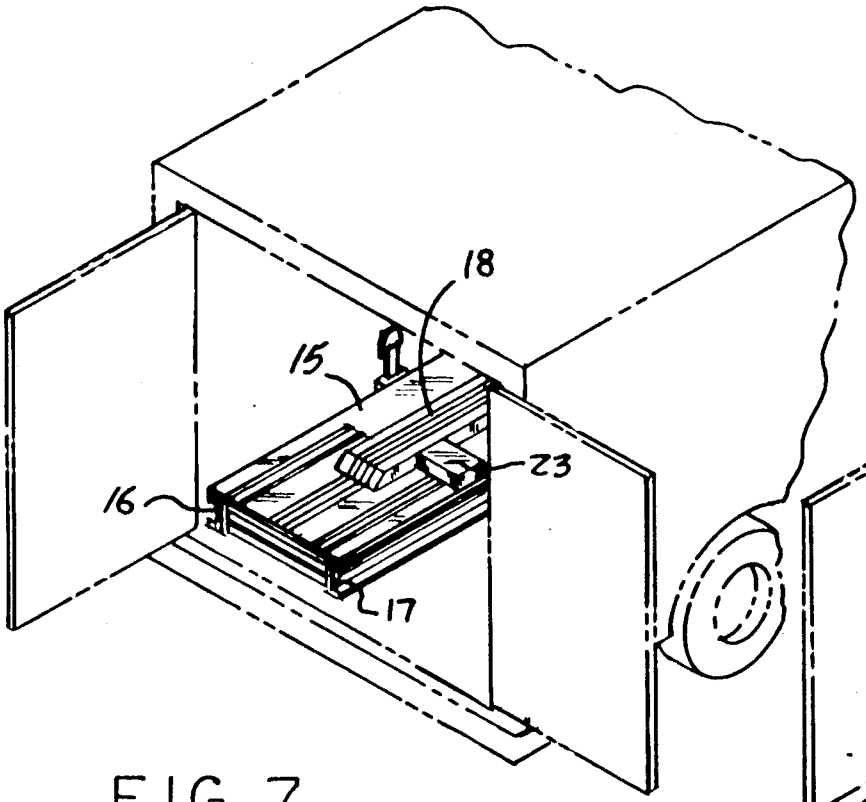
FIG. 7 is an isometric illustration of the invention in a retracted orientation relative to an associated vehicle.
Figure 10:
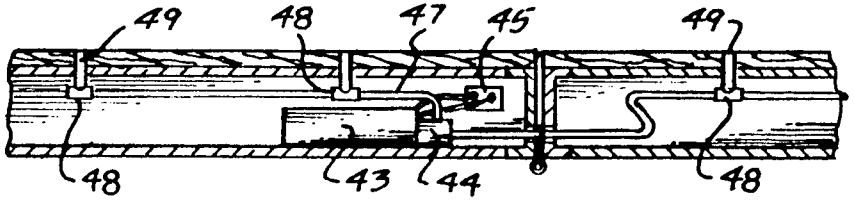
FIG. 10 is an orthographic view, taken along the lines 10—10 of FIG. 9 in the direction indicated by the arrows.

With reference to the FIGS. 7 and 8, the vehicle chair ramp apparatus 10 of the instant invention essentially comprises a housing 13 mounted to a vehicle floor 12 of an associated vehicle 11, such that the housing 13 includes an extension member 14 arranged for extension from between the first and second side walls 16 and 17 respectively of the housing 13. A housing top wall 15 extends between the first and second side walls 16 and 17, having a central plate 18 fixedly mounted medially of the housing top wall oriented parallel between the first and second side walls 16 and 17. The central plate 18 extends from a housing first end 19 to a spaced relationship relative to a housing second end 20, with the central plate 18 terminating in a central plate ramp 22 spaced from the housing second end 20. Central plate abutments 21 mounted to the central plate at the housing first end 19 are arranged for abutting a wheeled chair (not shown) at a first side of the wheeled chair such that an abutment block 23 extending along the top wall 15 in a spaced relationship extends between the central plate and the housing second side wall 17 for abutment of a wheeled chair forward wheel. With reference to the FIGS. 1 and 2 indicates the use of first and second strap housings 24 and 25 mounted to the first and second side walls respectively between the abutment block 23 and the housing first end 19. A first strap 26 is retractably mounted within the first strap housing 24, while a second strap 27 is retractably mounted within the second strap housing 25. The first strap is arranged to include a first strap connector **26*a*, with the second strap 27 having a second strap connector 27*a*. The first and second strap connectors 26*a* and 27*a* respectively are arranged for securement relative to one another and arranged to secure the vehicle chair onto the housing 13. First frictional strips 28 extending upon the central block to the housing second end are provided, wherein a wheeled chair framework is induced to be maintained in a fixed orientation during a secured orientation by the strap structure. Further, second and third friction strips 29 and 30 respectively extend along the top wall 15 in adjacency to the respective first and second side walls 16 and 17 to provide for friction surfaces during a wheeled chairs access into and out of the associated vehicle 11**.

Figure 2:
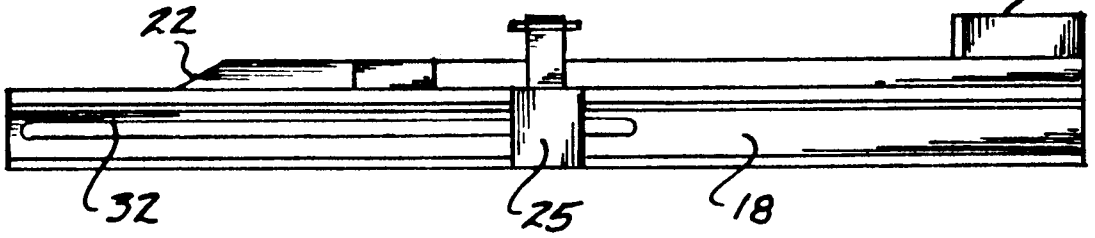
FIG. 2 is an orthographic side view of the housing of the invention.
Figure 3:
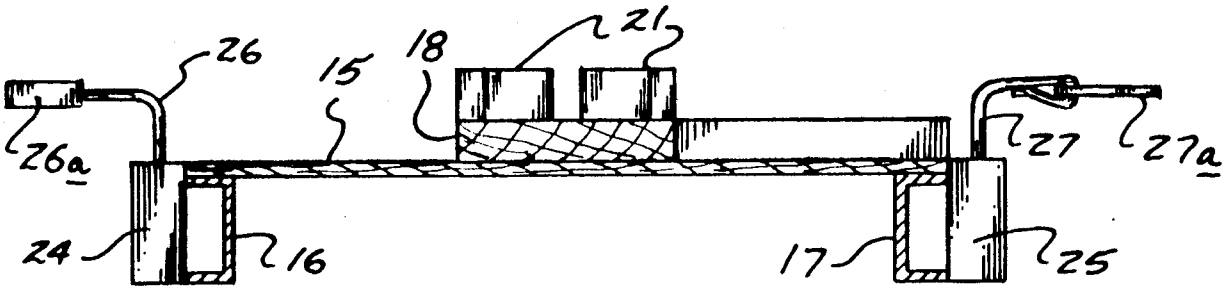
FIG. 3 is an orthographic view, taken along the lines 3—3 of FIG. 1 in the direction indicated by the arrows.
Figure 4:
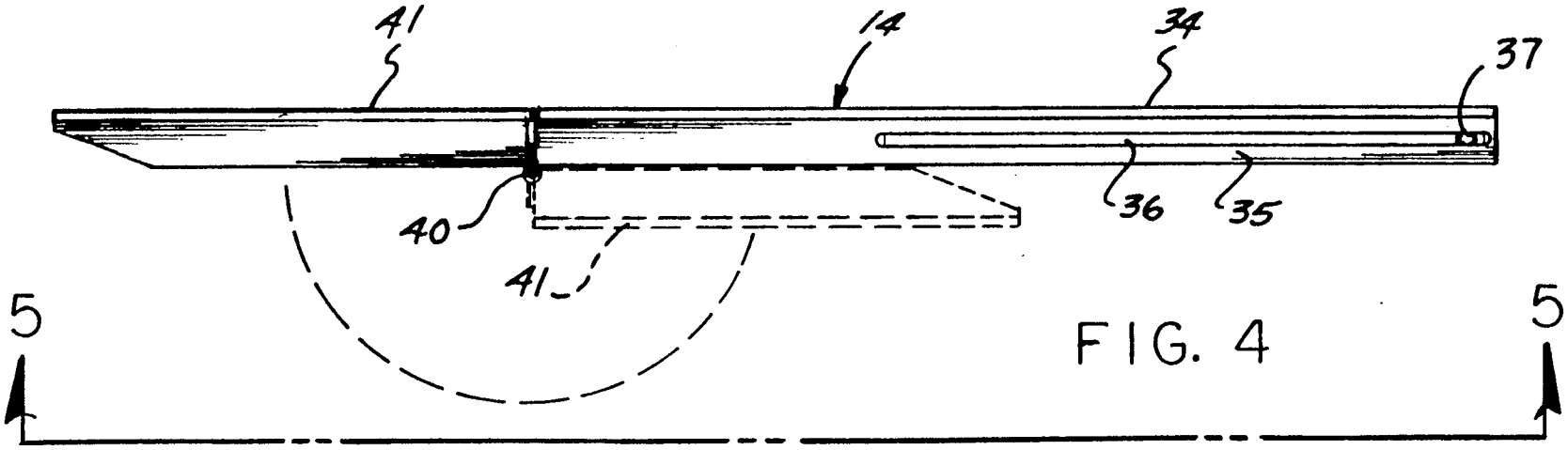
FIG. 4 is an orthographic side view of the extension member structure.
Figure 5:
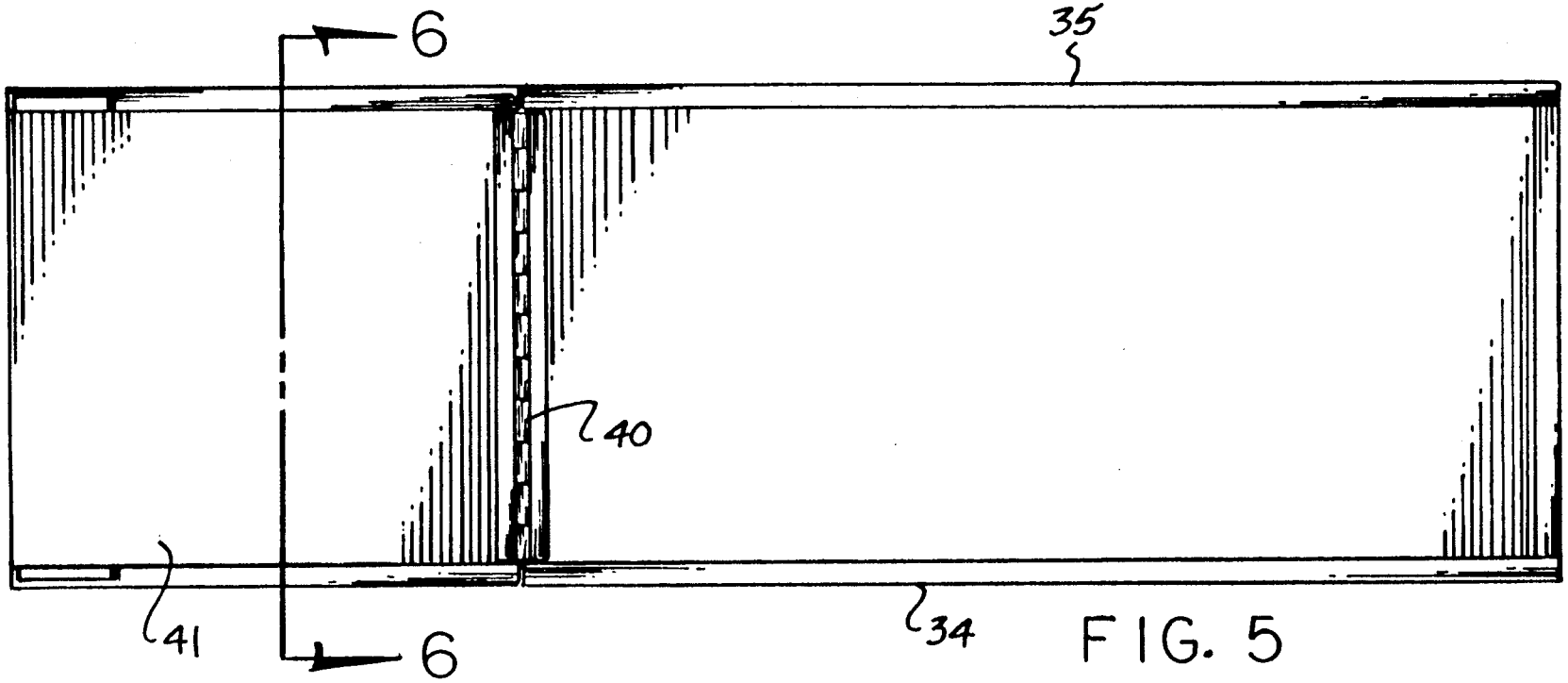
FIG. 5 is an orthographic view, taken along the lines 5—5 of FIG. 4 in the direction indicated by the arrows.
Figure 6:
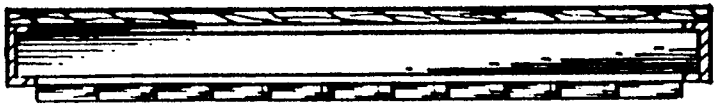
FIG. 6 is an orthographic view, taken along the lines 6—6 of FIG. 5 in the direction indicated by the arrows.
Figure 9:
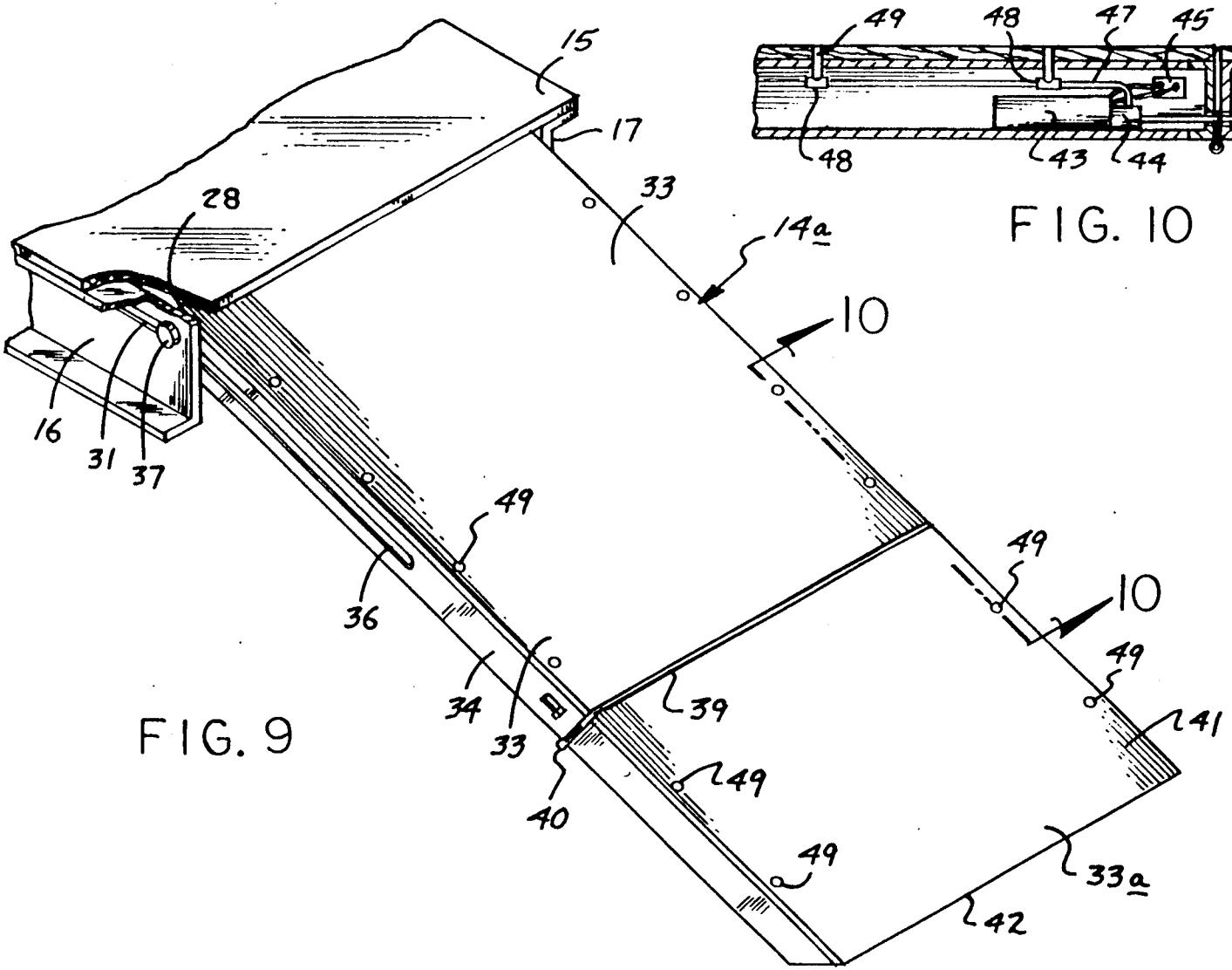
FIG. 9 is an isometric illustration of a modified extension ramp structure.

Respective first and second slots 31 and 32 are directed through the respective first and second side walls 16 and 17 of the housing 13, in a manner as indicated in the FIGS. 2, 4, and 9.

The extension member 14 includes an extension member top wall 33 with the extension member first and second respective side walls 34 and 35. The extension member first side wall 34 includes a first side wall slot 36, while the extension member first and second side walls 34 and 35 each include an extension member side wall slot 36 directed therethrough, having a slot lug 37 directed through each extension member side wall slot 36 and received through respective first and second slots 31 and 32 of the housing 13 to maintain alignment and securement of the extension member relative to the housing 13. The extension member 14 is arranged to include extension member first end 38 spaced from an extension member intermediate end 39, having a hinge 40 pivotally mounting an extension plate 41 to the intermediate end 39, with the extension plate 41 terminating in an extension member second end 42 spaced from the hinge and the intermediate end 40 and 39 respectively. A modified extension member **14*a* is illustrated in the FIGS. 9 and 10, to include a battery 43 contained between the extension member first and second side walls 34 and 35 in electrical communication with a switch 45 and illumination housing 44, having an illumination bulb therewithin, wherein a plurality of flexible fiber optic cables 47 are directed into the illumination housing 44 to direct illumination through the individual fiber optic cables 47. Each of the fiber optic cables 47 includes a plurality of junctions 48, wherein each of the junctions includes a fiber optic cable extension 49 extending from the junction 48 through the extension member top wall 33 of the extension plate top wall 33*a*. In this manner, the fiber optic cable extensions 49 are arranged to project through the extension member top wall and the extension plate top wall in a linear array along the respective extension member first and second side walls 34 and 35 to indicate the boundaries of the extension member 14*a*** during use of the structure in conditions of limited available light to assist in guidance of a wheeled chair along the extension member.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationhships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A vehicle chair ramp apparatus arranged for securement to a vehicle floor, wherein the apparatus comprises, a housing arranged for securement to the vehicle floor, wherein the housing includes a housing first side wall spaced from a housing second side wall in a parallel relationship, with a housing top wall extending between the housing first side wall and the housing second side wall, and an extension member having an extension member top wall, an extension member first side wall, and an extension member second side wall, with the extension member received between the housing first side wall, the housing second side wall, and the housing top wall, the housing first side wall having a first slot, the housing second side wall having a second slot, the extension member having an extension member first side wall slot, having a first slot lug received within the extension member first side wall slot and the first slot, with the extension member second slot lug received within an extension member second side wall slot that is positioned within the extension member second side wall, with the extension member second slot lug received through the second slot, with the first slot lug slidably mounted within the first slot and the extension member first side wall slot, and the second slot lug slidably received within the second slot and extension member second side wall slot, and the housing having a housing first end spaced from a housing second end, and a central plate abutment fixedly mounted to the top wall extending from the first end to a spaced relationship relative to the second end, with the central plate abutment mounted to the top wall at the first end, and an abutment block fixedly mounted to the housing top wall extending from the central plate abutment to the second side wall, with the abutment block adjacent to the central plate abutment, and a first strap housing mounted to the housing first side wall, and a second strap housing mounted to the second side wall, wherein the first strap housing and second strap housing are oriented between the central plate abutment and the abutment block, the first strap housing having a first strap retractably mounted within the first strap housing, and a second strap retractably mounted within the second strap housing, the first strap having a first strap connector, the second strap having a second strap connector, with the first strap connector and the second strap connector arranged for securement relative to one another.

2. An apparatus as set forth in claim 1 including at least one friction strip extending between the housing first end to the housing second end along the top wall, with the central plate having a central plate ramp oriented in a facing relationship relative to the housing second end, and at least one second friction strip mounted along the top wall proximate to the housing first side wall, and a second friction strip mounted to the housing top wall proximate to the housing second side wall.

3. An apparatus as set forth in claim 2 wherein the extension member includes an extension member first end spaced from an extension member second end, and an extension member intermediate end having a hinge, with the extension member having an intermediate end mounting said hinge, and an extension plate oriented within the extension member between the intermediate end and the extension member second end to pivotally mount the extension plate relative to the intermediate end.

4. An apparatus as set forth in claim 3 with a battery mounted between the extension member first side wall and the extension member second side wall secured to the extension member, and a switch directed through the extension member first side wall in electrical communication to the battery, and an illumination housing in electrical communication to the battery and the switch, wherein closing of the switch effects illumination within the illumination housing, and a plurality of flexible fiber optic cables directed into the illumination housing, with one of said fiber optic cables extending along the extension member first side wall, and a further one of said fiber optic cables extending along said extension member second side wall, with each of said fiber optic cables including a plurality of fiber optic cable junctions, and each of said junctions including a fiber optic cable extension extending therefrom, wherein a plurality of said fiber optic cable extensions project through the extension member top wall in a first linear array proximate to the extension member first side wall, and a further plurality of said fiber optic cable extensions projecting through the extension member top wall in adjacency to the extension member second side wall in a further linear array, wherein the linear array and the further linear array indicate accessibility along the extension member top wall and along the extension plate for access of a wheeled chair.

* * * * *